US005445372A

United States Patent [19]

Blaser et al.

[11] Patent Number: 5,445,372

[45] Date of Patent: Aug. 29, 1995

[54] DEVICE FOR DEPOSITING PRINTED SHEETS ON A SHEET PILE

[75] Inventors: Peter T. Blaser, Dielheim; Dieter Hauck, Eberbach; Karl-Hermann Miltner, Dossenheim, all of Germany

[73] Assignee: Heidelberger Druckmaschinen AG, Heidelberg, Germany

[21] Appl. No.: 227,497

[22] Filed: Apr. 14, 1994

Related U.S. Application Data

[63] Continuation of Ser. No. 7,051, Jan. 21, 1993, abandoned.

[30] Foreign Application Priority Data

Jan. 21, 1992 [DE] Germany ..... 42 01 480.8

[51] Int. Cl.[6] ..... B65H 29/54

[52] U.S. Cl. ..... 271/309; 271/204; 271/211

[58] Field of Search ..... 271/276, 277, 196, 183, 271/202, 204, 206, 211, 309

[56] References Cited

U.S. PATENT DOCUMENTS

| | | | |
|---|---|---|---|
| 3,556,519 | 1/1971 | Keller | 271/211 |
| 4,083,556 | 4/1978 | Schilling et al. | 271/204 |
| 4,317,563 | 3/1982 | Zimmerman et al. | 271/211 |
| 4,643,414 | 2/1987 | Weisgerber | 271/206 |
| 4,702,468 | 10/1987 | Pollich | 271/211 |
| 5,251,891 | 10/1993 | Blaser et al. | 271/183 |
| 5,259,608 | 11/1993 | Pollich | 271/183 |

FOREIGN PATENT DOCUMENTS

| | | |
|---|---|---|
| 3413179 | 10/1985 | Germany . |
| 2156786 | 10/1985 | United Kingdom . |

*Primary Examiner*—H. Grant Skaggs
*Attorney, Agent, or Firm*—Herbert L. Lerner; Laurence A. Greenberg

[57] ABSTRACT

Device for depositing printed sheets on a sheet pile, including at least one pair of mechanical grippers for seizing the printed sheets at a respective leading edge thereof, the gripper pair being movable over the sheet pile and being controllable for releasing the printed sheets at a given instant of time, a pneumatic device for applying varying pressure to defined regions over a depositing surface of the respective printed sheets for decelerating and transporting the sheets against a mechanical stop, and adjusting elements for the grippers and the pneumatic device, also includes a control device including a computer and having an input and an output, the control device being connected via the output thereof to the adjusting elements, an input device for receiving sheet-specific and process-specific data being connected to the control device via the input thereof, the sheet-specific and process-specific data including data regarding two-dimensional mass distribution of the respective printed sheet, the adjusting elements of the pneumatic device being controllable by the control device so as to produce a pressure distribution on the depositing surface of the respective printed sheet which is correlated with the mass distribution of the respective printed sheet.

7 Claims, 2 Drawing Sheets

MASS DISTRIBUTION MEASURING DEVICE
INPUT DEVICE
CONTROL DEVICE
1
2
3
4
5
6
7
8
9
10
11
12
12a
13
14
14a
14b

P
Y
M
C
B
15
3
16
9
14
17
18
20
20'
19

DEVICE FOR DEPOSITING PRINTED SHEETS ON A SHEET PILE

This application is a continuation, of application Ser. No. 08/007,051, filed Jan. 21, 1993 now abandoned.

SPECIFICATION

The invention relates to a device for depositing printed sheets on a sheet pile, in particular, in the delivery of a printing machine. The invention may also be used to pile sheet-like material or similarly flat objects which have been printed on or coated prior to piling and which have to be removed from a machine or device by means of a pair of grippers or a plurality of gripper pairs and a pneumatic device, such as an air-blowing or suction device, and conveyed onto a sheet pile where they are to be deposited.

German Published Patent Document DE-OS 34 13 179 Al describes a control and regulating device for a sheet delivery of a printing machine, which is provided with various adjustable elements for achieving an accurate deposition of the sheets onto a sheet pile, the adjustable elements being adjustably movable in a defined manner by means of a control and regulating device under a plurality of influences. Thus, provision is made, inter alia, for the instant of time at which the sheet-conveying grippers release the respective sheet, and the quantity of air supplied by the air-blowing or suction device to be variable by means of adjusting motors and solenoid valves, respectively; a comparison of actual and reference values being made continuously for adjusting purposes. The reference value is pre-determined via a computer which calculates the reference values based upon empirically determined data which are stored in the form of fields of characteristic curves, taking into account data regarding paper weight, sheet size and rotary machine speed which are inputted into the computer via an input device.

In the foregoing German patent document, a description of an embodiment is provided which includes an explanation of how the accurate setting of an air-blowing or blowing-air device is to be effected. The empirical setting or adjustment of the rotary speed of fans directed onto an upper side of a respective sheet to be deposited takes into account the weight of the ink which is printed on the sheet. In setting the rotary speed of the fans, the air blowing from above is adjusted so as to blow more strongly on the half of the sheet showing only little printing or no printing at all, or the fans above the other half of a respective sheet having more printing thereon are switched off, if necessary. An improvement may be attained when, in order to set the rotary speed of the fans empirically, data regarding the concentrative distribution of ink, which is stored in the computer for a respective inking unit, is utilized.

What is disadvantageous for such a solution is that the setting of the pressure ratio of the air-blowing device is effected empirically, i.e., based upon skill and/or experience gained by the operator, so that the reference values obtained therefrom are operator-dependent and, accordingly, subject to human error. Furthermore, only data for the zonewise application of ink and paper weight are entered into the computer via the input device for the purpose of forming the reference values so that other quantities, such as of dampening medium and powder, for example, which influence the mass of the sheet during the printing process, are not taken into account.

With respect to the control and regulating device according to the aforediscussed German patent document, only the zonewise ink application, as it may be stored in the computer for the inking unit, is used for the empirical formation of reference values. In many cases, however, the ink is distributed rather uniformly on a printed sheet transversely to the sheet travel direction whereas, as viewed seen in the sheet travel direction, the ink application on the printed sheet is very non-uniform. If this non-uniform distribution is neglected when setting the pressure of the blowing device, problems with respect to the accuracy and velocity at which the sheets are deposited are likely to arise.

Another German Published Patent Document DE-OS 28 37 579 Al describes a device for rapidly depositing sheet-like material wherein, by means of a suction roller disposed in front of a sheet pile and by means of transversely and longitudinally extending blowing pipes disposed above the sheet pile, the velocity of a sheet to be deposited is decelerated, and the sheet is deposited on the sheet pile. The air in the transversely and longitudinally extending blowing pipes is controlled so that, initially, the sheet is subjected to a linear blown-air flow directed from above which travels at sheet-conveying velocity, and so that, after having been released from the grippers, the sheet is subjected to a blown-air flow proceeding from above longitudinally to the sheet-conveying direction and, beginning from the center line of the sheet, extending linearly outwardly.

With the last-mentioned conventional device, however, the printed sheets are subjected to blowing air independently or irrespective of the printed image-dependent material which is applied. With every type of sheet, a sufficiently excessive quantity of blowing air is directed onto the sheet surface so as to ensure forcibly that, for all possible sheet sizes or formats, printed images and other process conditions, the sheet is pressed onto the sheet pile by means of convex transverse and longitudinal deformations, which should cause the air cushion to escape from underneath the sheet as quickly as possible. Because a considerable amount of air is needed, the transversely and longitudinally extended blowing pipes are constructed as voluminous air-storage vessels, which are undesirable for effecting a quick adjustment of the quantities of air. Due to the asymmetrical mass distribution which is dependent upon the printed image, the sheets are not deposited uniformly, beginning at the center and extending outwardly towards the sheet margins, but are deformed rather uncontrollably, which is obstructive to an accurate pile formation. Furthermore, the large quantities of air cause vagabond or stray air flows which also have a negative effect upon pile formation. In addition, a high consumption of air is costly and noise-producing.

The invention seeks to improve the precision and speed with which a printed sheet may be deposited upon a sheet pile. It is accordingly an object of the invention to provide a device which permits an air-blowing or suction device to be set irrespectively or independently of empirically obtained setting values, all factors essential to the application of material onto the sheet being taken into account.

With the foregoing and other objects in view, there is provided, in accordance with the invention, a device for depositing printed sheets on a sheet pile, including at least one pair of mechanical grippers for seizing the printed sheets at a respective leading edge thereof, the gripper pair being movable over the sheet pile and being controllable for releasing the printed sheets at a given instant of time, a pneumatic device for applying varying pressure to defined regions over a depositing surface of the respective printed sheets for decelerating and transporting the sheets against a mechanical stop, and adjusting elements for the grippers and the pneumatic device, comprising a control device including a computer and having an input and an output, the control device being connected via the output thereof to the adjusting elements, an input device for receiving sheet-specific and process-specific data being connected to the control device via the input thereof, the sheet-specific and process-specific data including data regarding two-dimensional mass distribution of the respective printed sheet, the adjusting elements of the pneumatic device being controllable by the control device so as to produce a pressure distribution on the depositing surface of the respective printed sheet which is correlated with the mass distribution of the respective printed sheet.

The fact that the pressure distribution of the pneumatic device corresponds to or is correlated with the actual two-dimensional mass distribution ensures that the sheet is deposited on a sheet pile precisely and rapidly. The device acts upon the sheet in a manner that the sheet does not necessarily have to be deposited initially in the center but may rather be deposited in a manner that, beginning at that part of the sheet which has been deposited first and which is usually off center, the air underneath the sheet quickly escapes therefrom.

In accordance with another feature of the invention, the sheet-specific and process-specific data include data regarding paper weight and an application of material to the respective sheet for producing a printed image.

In accordance with a further feature of the invention, a device connected to the control device is provided for measuring the mass distribution of the respective sheets assigned to the sheet pile.

It is advantageous to divide the sheet surface into matrix-like areas when determining the mass distribution and to determine, in addition to the paper weight, which is generally already known, the mass of ink, varnish, dampening medium and powder applied to the matrix-like areas, allowing for vaporization and/or loss of powder.

In accordance with an added feature of the invention, the pneumatic device is an air-blowing device having means for varying air quantity and acting direction of blowing air depending upon location and velocity of the respective sheets for an elemental area of the depositing surface of the printed sheet, the depositing surface being divided in a matrix-like manner.

In accordance with an additional feature of the invention, the air-blowing device is formed with air-outlet openings which are openable and closable, respectively, independently of one another.

In accordance with respective concomitant and alternative features of the invention, the pneumatic device is a suction device having means for varying air quantity and acting direction of suction air depending upon location and velocity of the respective sheets for an elemental area of the depositing surface of the printed sheet, the depositing surface being divided in a matrix-like manner; and the suction device is formed with air-intake openings which are openable and closable, respectively, independently of one another.

Furthermore, the pneumatic device may include a blowing-air or air-blowing device acting on the sheet from above, and supported by a suction device provided at the side of the sheet pile. The two-dimensional mass distribution may be precisely pre-set by means of a computer or determined by means of a measuring device provided inside or outside the sheet-processing machine.

Devices for measuring the weight of the pile prior to and after the printing process may be provided as auxiliary devices. Depending upon the respective structural embodiment of the invention, the pressure distribution produced by the air-blowing or suction device and corresponding to the mass distribution may be set in various ways. Thus, it is possible to vary the amount of blowing air or suction air, the number of blowing or suction units switched on, the location and instant of time at which the blowing and suction units are applied, and the direction of the suction or blowing effect, depending upon the sheet-specific and machine-specific data known.

From the construction standpoint, it is advantageous to provide, above the sheet pile, an air-blowing device formed with air-outlet openings distributed over the sheet surface in a matrix-like manner, each of the nozzles having the capability of being supplied with blowing air by means of the control device. It is thereby possible to permit the escape of blowing air from the nozzles directed onto an area of the sheet which is to be deposited first, prior to permitting the escape of blowing air from the remaining nozzles. Moreover, it is possible to switch off rows of nozzles successively in areas beginning at a respective trailing edge and extending towards a respective leading edge of the sheet.

Other features which are considered as characteristic for the invention are set forth in the appended claims.

Although the invention is illustrated and described herein as embodied in a device for depositing printed sheets on a sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figures 1, 1A:
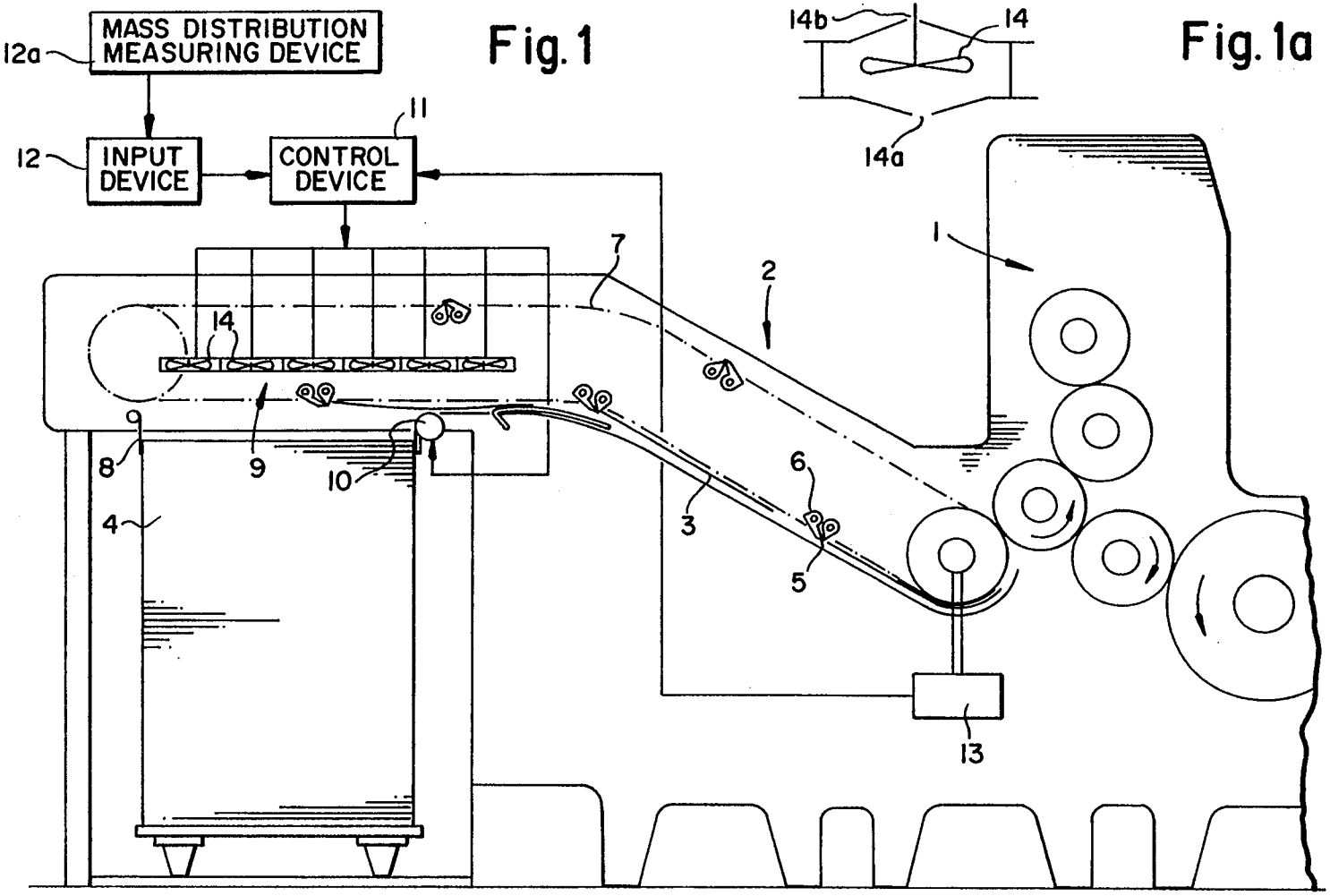
FIG. 1 is a fragmentary diagrammatic and schematic elevational view of a sheet-fed printing machine.
FIG. 1*a* shows details of the air-blowing device with openable and closeable air outlet openings.

Referring now to the figures of the drawing and first, particularly, to FIG. 1 thereof, there is shown therein a last printing unit 1 of a sheet-fed printing machine followed by a delivery 2 for depositing printed sheets 3 on a sheet pile 4. In the delivery 2, the sheets 3 are held at respective leading edges 5 thereof by means of grippers 6 and, via conveyor chains 7, are transported over the sheet pile 4 and deposited at a stop 8. The delivery 2 includes an air-blowing device 9 and a conventional suction roller 10 for conveying and decelerating the velocity of the sheets 3, the air-blowing device 9 and the suction roller 10 being connected to an output of a control device 11. Via respective inputs, the control device 11 is connected to an input device 12 for sheet-specific and process-specific data and to an incremental rotary encoder 13 which measures the angle and velocity of the main printing-machine drive. In order to deposit the sheets 3 on the sheet pile rapidly and accurately, the air-blowing device 9 is formed of a number of fans 14 arranged in a matrix-like manner, each thereof being capable of being switched on by means of the control device 11. Via the input device 12, connected with a mass distribution measuring device 12*a*, data regarding the two-dimensional mass distribution of the printed paper sheet 3 are inputted into the control device 11 which contains a non-illustrated computer. In addition to the weight of the paper, the data also includes information regarding the print-dependent material which is applied thereto, in particular, regarding the mass of the ink, the varnish, the dampening medium and the powder. The data may be computed based upon a digitalized printed image or may be measured inside or outside the printing machine by means of a suitable non-illustrated device. The fans 14 are switched on and off, respectively by means of openable and closeable air openings 14*a* and 14*b*, and the suction roller 10 is controlled in accordance with this data and further sheet-specific and process-specific data such as, for example, information regarding sheet size, paper thickness and signals received from the rotary encoder 13.

Figure 2:
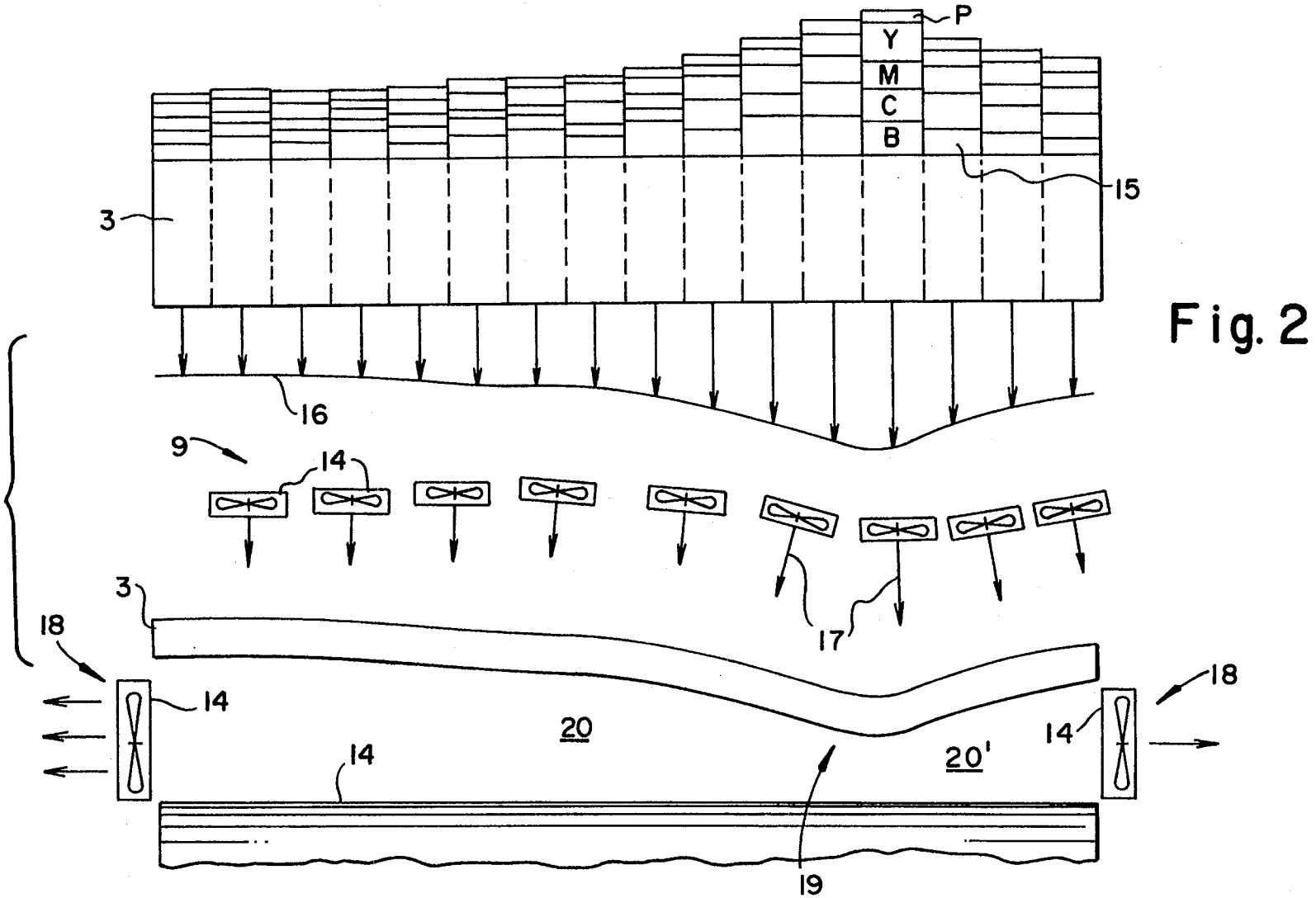
FIG. 2 is a schematic view of equipment according to the invention for effecting a print-dependent setting of an air-blowing device by means of a control device.

FIG. 2 schematically and diagrammatically illustrates the print-dependent setting or adjustment of the air-blowing device 9 by means of the control device 11. The sheet 3 has disposed thereon a mass application shown divided into sixteen zones 15, the mass application being made up of four layers of ink and dampening-medium B, C, M, Y and a layer of powder P. Based upon this mass application, the mass distribution thereof on the sheet 3 is determined, as represented diagrammatically by a curve 16 in FIG. 2. The fans 14 are activated by the control device 11 in accordance with the mass distribution, so as to produce a pressure distribution on the sheet 3 which, with respect to the switched-on time duration, and the intensity and direction of blowing air, corresponds to the mass distribution. The arrows 17 symbolize the intensity and direction of the blowing air.

In accordance with respective concomitant and alternative features of the invention, the pneumatic device is a suction device 18, FIG. 2, having means for varying air quantity and acting direction of suction air depending upon location and velocity of the respective sheets 3 for an elemental area of the depositing surface of the printed sheet the depositing surface being divided in a matrix-like manner; and the suction device 18 is formed with air-intake openings which are openable and closable, respectively, independently of one another.

Furthermore, the pneumatic device may include a blowing-air or air-blowing device acting on the sheet from above, and supported by a suction device 18 provided at the side of the sheet pile 4. The two-dimensional mass distribution may be precisely pre-set by means of a computer or determined by means of a measuring device provided inside or outside the sheet-processing machine.

We claim:

1. Device for depositing printed sheets on a sheet pile, comprising at least one pair of mechanical grippers for seizing the printed sheets at a respective leading edge thereof, the gripper pair being movable over the sheet pile and being controllable for releasing the printed sheets at a given instant of time, an air-blowing device for applying varying pressure to defined regions over a depositing surface of the respective printed sheets for decelerating the sheets before contact with a mechanical stop, a suction device supporting said air-blowing device disposed at the side of said sheet pile, suction control means for controlling said suction device, a control device for controlling the air-blowing device having at least one input and an output, said control device being connected via said output thereof to the air-blowing device, an input device for receiving sheet-specific and process-specific data being connected to said control device via said input thereof, a mass distribution measuring device for measuring said sheet-specific and process-specific data connected to said input device, said sheet-specific and process-specific data including data regarding two-dimensional mass distribution of the respective printed sheet, the air-blowing device being controllable by said control device so as to produce a pressure distribution on the depositing surface of the respective printed sheet which is correlated with said mass distribution of the respective printed sheet; wherein said air-blowing device includes means for varying air quantity and acting direction of blowing air depending upon location and velocity of the respective sheets for an elemental area of the depositing surface of the printed sheet, said depositing surface being divided in a matrix-like manner.

2. Device according to claim 1, wherein said sheet-specific and process-specific data include data regarding paper weight and an application of material to the respective sheet for producing a printed image.

3. Device according to claim 1, including a device for measuring the mass distribution of the respective sheets assigned to the sheet pile and being connected to said control device.

4. Device according to claim 1, wherein said air-blowing device is formed with air-outlet openings which are openable and closable, respectively, independently of one another.

5. Device according to claim 1, wherein said suction control means include means for varying air quantity and acting direction of suction air depending upon location and velocity of the respective sheets for an elemental area of the depositing surface of the printed sheet, said depositing surface being divided in a matrix-like manner.

6. Device according to claim 1, wherein said suction device is formed with air-intake openings which are openable and closable, respectively, independently of one another.

7. A method for depositing printed sheets on a sheet pile of a printing machine having at least one pair of grippers for seizing printed sheets at a respective leading edge thereof, the gripper being movable over the sheet pile and being controllable for releasing the printed sheets at a given instant of time, an air-blowing device for applying varying pressure to defined regions over a depositing surface of the respective printed sheets before contact with a mechanical stop, a suction device supporting said air-blowing device disposed at a side of the sheet pile, suction control devices for controlling the suction device, a control device for controlling the air-blowing device having at least one input and output, said control device being connected via said output thereof to the air-blowing device for receiving sheet-specific and process-specific data being connected via said input thereof, a mass distribution measuring device for measuring said sheet-specific and process-specific data connected to said input device, the method which comprises the steps of:

determining with the control device a part of the depositing surface which is correlated with the mass distribution of the printed sheet, and controlling with the control device the air-blowing device to produce a pressure distribution on the sheet so that the intensity and direction of blowing air corresponds with the mass distribution of the printed sheet.

* * * * *